United States Patent [19]

Frohbieter

[11] Patent Number: 4,732,009

[45] Date of Patent: Mar. 22, 1988

[54] REFRIGERATOR COMPARTMENT AND METHOD FOR ACCURATELY CONTROLLED TEMPERATURE

[75] Inventor: Edwin H. Frohbieter, Lincoln Township, Berrien County, Mich.

[73] Assignee: Whirlpool Corporation, Benton Harbor, Mich.

[21] Appl. No.: 878,674

[22] Filed: Jun. 26, 1986

[51] Int. Cl.[4] ..... F25D 17/06

[52] U.S. Cl. ..... 62/89; 62/97; 62/187; 62/382; 62/441

[58] Field of Search ..... 62/126, 130, 186, 231, 62/382, 419, 441, 447, 187, 89, 97

[56] References Cited

U.S. PATENT DOCUMENTS

| | | | |
|---|---|---|---|
| 3,005,321 | 10/1961 | Devery . | |
| 3,075,366 | 1/1963 | Jung | 62/441 X |
| 3,090,209 | 5/1963 | Hubacker . | |
| 3,122,005 | 2/1964 | Constantini et al. . | |
| 3,243,972 | 4/1966 | Wiese | 62/441 X |
| 3,411,312 | 11/1968 | Sigl et al. | 62/187 X |
| 3,466,891 | 9/1969 | Maxwell | 62/441 X |
| 3,645,108 | 2/1972 | Houk | 62/187 |
| 3,659,429 | 5/1972 | McLean . | |
| 3,733,841 | 5/1973 | Gelbard . | |
| 3,747,361 | 7/1973 | Harbour . | |
| 4,358,932 | 11/1982 | Helfrich, Jr. . | |
| 4,368,622 | 1/1983 | Brooks | 62/441 X |
| 4,488,412 | 12/1984 | Weaver | 62/441 X |
| 4,586,347 | 5/1986 | McCarty . | |

*Primary Examiner*—Lloyd L. King

*Attorney, Agent, or Firm*—Hill, Van Santen, Steadman & Simpson

[57] ABSTRACT

A refrigerator-freezer has a separate controlled temperature compartment and method that includes a freezer air siphon for drawing air from a horizontal mid-portion of the freezer and mixing the freezer air within a plenum with air circulating through the separate compartment. An air return is provided to the freezer from the separate compartment, while an inlet in the plenum, at which is mounted a temperature sensor for controlling a fan, draws air from the compartment into the plenum for mixing and for recirculation.

22 Claims, 10 Drawing Figures

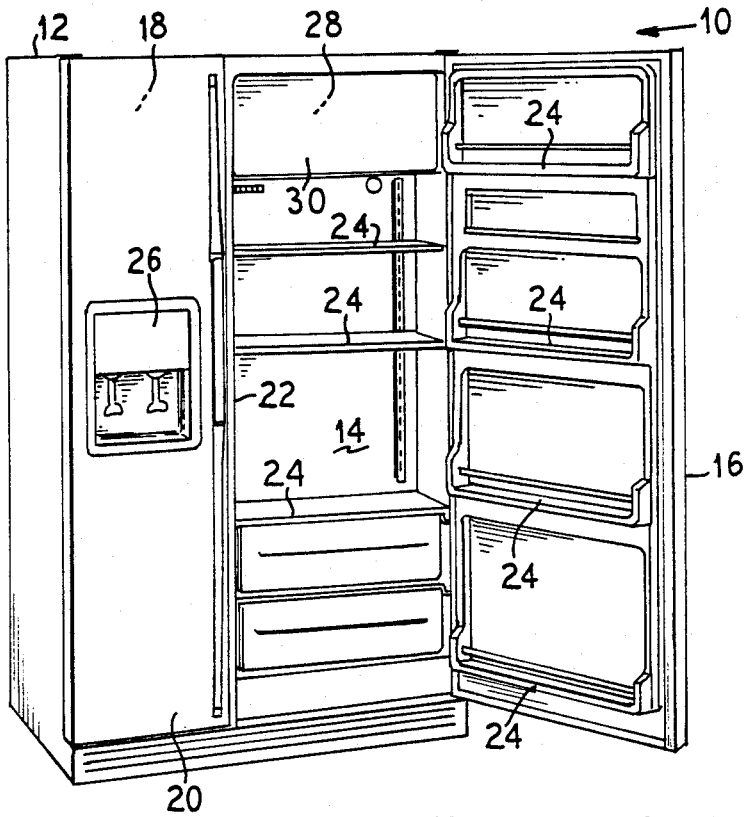
FIG. 1
FIG. 2
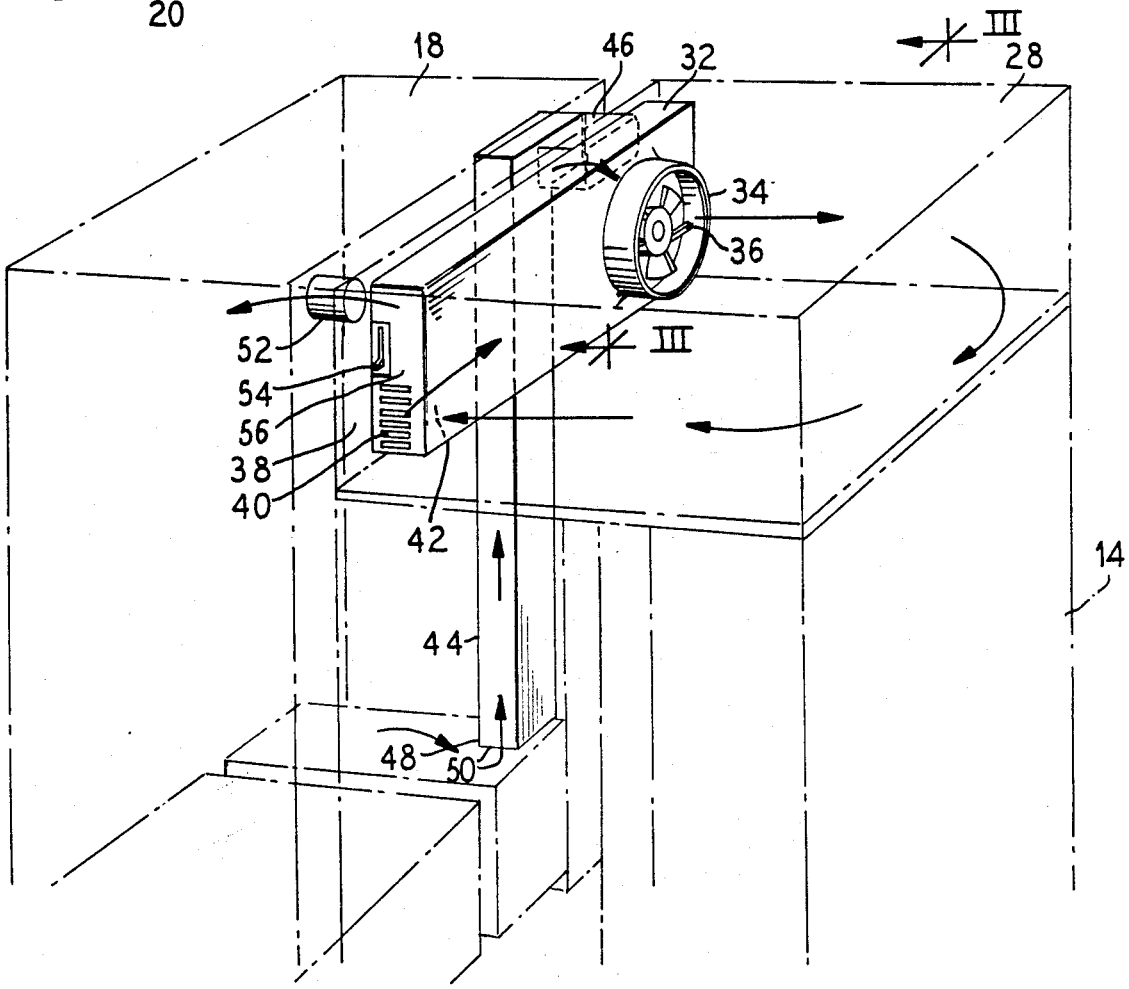

REFRIGERATOR COMPARTMENT AND METHOD FOR ACCURATELY CONTROLLED TEMPERATURE

BACKGROUND OF THE INVENTION

1. Field of the Invention

The present invention relates generally to a separate compartment and method in a combination refrigerator-freezer having means for drawing cold air from the freezer and mixing the cold air with compartment air for circulation through the compartment.

2. Description of the Prior Art

A refrigerated compartment having a fan that draws air from the compartment and mixes that air with air drawn through a flue from the top of the freezer compartment is disclosed in U.S. Pat. No. 3,090,209. A thermostat is included, located in the refrigerated compartment, to control the operation of the fan.

U.S. Pat. No. 3,659,429 discloses a fast chill space in a refrigerator having an auxiliary timer controlled fan adjacent an inlet passage from the freezer, which passage includes a thermostatically controlled damper. The inlet passage draws air from the top of the freezer adjacent evaporator openings from which cool air is discharged during cooling cycles.

U.S. Pat. No. 3,747,361 discloses a refrigerator having a fast chill compartment similar to that disclosed in the '429 patent which includes a switch for continuously running the fan. In an alternate position, the switch varies the fan operation dependent on the compartment thermostat state.

U.S. Pat. No. 3,733,841 discloses an air flow control which mixes refrigerator compartment air with freezer compartment air and utilizes a temperature sensor to control operation of the compressor.

U.S. Pat. No. 4,358,932 discloses a fast chill compartment which utilizes a microcomputer to control the fan operation time.

U.S. Pat. No. 3,122,005 discloses a refrigerator-freezer combination having an evaporator in the divider wall and a fan that draws air in through the side wall of one of the compartments.

U.S. Pat. No. 3,005,321 discloses a multiple compartment refrigerator-freezer which utilizes two fans to control the air flow and temperature.

SUMMARY OF THE PRESENT INVENTION

The present invention provides a device and method for supplying cool, relatively constant temperature freezer compartment air to a separate compartment to establish and maintain an accurate temperature within the compartment. The present invention also provides a device and method for maintaining a low temperature gradient throughout a long-term food storage compartment.

The present invention is embodied in a refrigerator-freezer having a separate compartment maintained at an accurate temperature, preferably near or just below the freezing point of water, to provide a storage location for long-term storage of perishable foods without freezing. The compartment, known as a "super cool" compartment, includes a cold air siphon to draw chilled air from near a mid-portion of the freezer compartment into a plenum chamber in the controlled temperature compartment. The freezer air is mixed in the plenum chamber with air from the super cool compartment and circulated by a high capacity fan throughout the compartment so that a low temperature gradient is maintained across the entirety of the compartment.

The low compartmental temperature gradient and the accurately controlled temperature of the present super cool compartment enable foods to be stored for extended times without risk of spoilage. The temperature can be set to and maintained at a very precise point so that freezing is not required. At lower temperatures, even longer storage can be provided for foods that are less susceptible to chilling injury.

BRIEF DESCRIPTION OF THE DRAWINGS

FIG. 1 is a perspective view of a side-by-side refrigerator-freezer, including an accurately controlled temperature compartment according to the principles of the present invention;

FIG. 2 is a partial perspective view, in phantom, of the refrigerator-freezer of FIG. 1 showing an air flow duct arrangement and fan housing for the compartment of the present invention;

DESCRIPTION OF THE PREFERRED EMBODIMENTS

Figure 3:
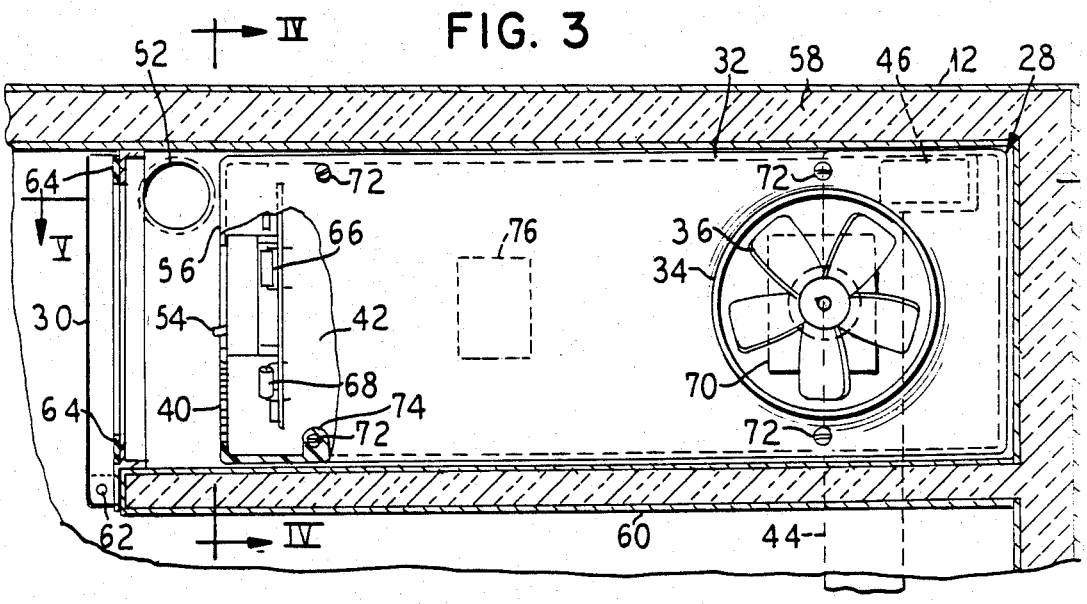
FIG. 3 is a vertical cross-section along lines III—III of FIG. 2 showing additional details of the present invention.

FIG. 1 shows a side-by-side refrigerator-freezer, generally at 10, including a cabinet 12 containing a refrigerator compartment 14 having an openable door 16 and a freezer compartment 18 having an openable door 20. A common dividing wall 22 separates the refrigerator compartment 14 from the freezer compartment 18. A plurality of shelves 24 are mounted within both the refrigerator and freezer compartments 14 and 18, as well as on the interior surfaces of the doors 16 and 20. In the embodiment shown, a chilled water and ice access panel 26 is provided at an exterior of the freezer door 20. A controlled temperature compartment 28 is provided above the refrigerator compartment 14 that includes an interior door 30 which is accessible upon opening of the refrigerator door 16.

In FIG. 2, the controlled temperature, or supercool, compartment 28 is shown above the refrigerator compartment 14 and beside the freezer compartment 18. A plenum housing 32 having a shaped fan housing portion 34 within which is rotatably mounted a fan 36 is mounted on an inside wall 38 of the super cool compartment 28. The plenum 32 includes air inlet slots 40 spaced from the fan housing 34. As the fan 36 operates, air is drawn from the temperature controlled compartment 28, through the inlet slots 40, and into a plenum chamber 42 in the interior of the plenum 32.

A freezer air siphon, or dip tube, 44 is mounted within the freezer compartment 18 and includes an upper end 46 in communication with the plenum chamber 42, as well as a lower end 48 extending to near a mid-portion of the freezer compartment 18. The lower end 48 has at least one freezer air inlet 50 formed therein so that freezer air is drawn from a mid-portion of the freezer compartment 18, along the siphon 44, and into the plenum chamber 42.

A return duct 52 extends through the divider wall 22 between the controlled temperature compartment 28 and the freezer compartment 18 through which air returns from the compartment 28 to the freezer 18. A temperature selection control 54 is provided on a front face portion 56 of the plenum 32 by which the temperature within the controlled temperature compartment 28 can be adjusted.

As shown by the arrows, the operation of the fan 36 creates an air flow from the fan housing 34 of the plenum 32 into and throughout the interior of the controlled temperature compartment 28. After circulation, a portion of the air returns into the plenum chamber 42 at the air inlets 40 and is carried therethrough for recirculation by the fan 36. The operation of the fan 36 creates a low pressure zone within the plenum chamber 42 which causes air to be drawn from the freezer compartment 18, into the siphon inlet 50, upward through the freezer air siphon 44 and into the plenum chamber 42, where it is mixed, or tempered, with the air from the controlled temperature compartment 28 prior to being exhausted by the fan 36. As air is removed from the mid-portion of the freezer 18 by the siphon, or dip tube, 44, air within the controlled temperature compartment 28 is returned to the freezer compartment 18 through the air return duct 52. The present invention, thereby, mixes cool freezer air with air circulating through the controlled temperature compartment 28 to provide temperature regulation of the air within the compartment 28.

Referring to FIG. 3, the controlled temperature, or super cool, compartment 28 is partially enclosed by insulated walls 58 of the cabinet 12, including a lower insulated wall 60 between the compartment 28 and the refrigerator 14. The door 30 completes the enclosure and is mounted to the lower wall 60 by a hinge 62. A gasket 64 may also be provided at the perimeter of the door 30 to ensure an effective seal between the generally warmer refrigerator compartment 14 and the super cool compartment 28.

The temperature selection control 54, in the embodiment shown, is a slide control projecting from the face portion 56. The slide control 54 adjusts control circuitry 66 contained within the plenum chamber 42. Included in the control circuitry 66 and mounted just within the plenum chamber 42 at the inlet openings 40 is a temperature sensor 68. The temperature sensor 68 detects temperature changes in the air flowing in through the inlet slots 40 and, through the control circuitry 66, switches into and out of operation a fan motor 70 which drives the fan 36. The temperature sensor 68 is preferably mounted close enough to the air slots 40 to sense the ambient temperature within the compartment 28 even when the fan 36 is not in operation. Inlet slots 40 are located in the front portion of compartment 28 while fan 36 is located at the rear portion of the compartment. This arrangement assures adequate air flow and hence low temperature gradients throughout the controlled temperature compartment.

The plenum housing 32 is mounted to the refrigerator-freezer dividing wall 22 by a plurality of screws 72 extending through sockets 74 in the plenum 32. Mounted within the plenum chamber 42, in some embodiments, is a heater 76. The heater 76 is controlled by the control circuitry 66 to warm the air that was drawn into the plenum chamber 42 by the fan 36 should the temperature within the temperature controlled compartment 28 fall below the predetermined set temperature set by the slide control 54. A small dead band is built into the control circuitry 66 so that during heating the air temperature is heated to the set temperature minus the dead band. It will be understood that the set temperature can be fixed in some embodiments.

The fan 36 is preferably of relatively large capacity compared to the size of the compartment 28 so that a high volume of air is circulated therethrough to maintain an extremely low temperature gradient within the compartment 28.

The upper end 46 of freezer air siphon 44 is generally at the same level as the air return duct 52. Otherwise, there may be a tendency for a thermally induced air flow between the freezer 18 and the super cool compartment 28.

Figure 4:
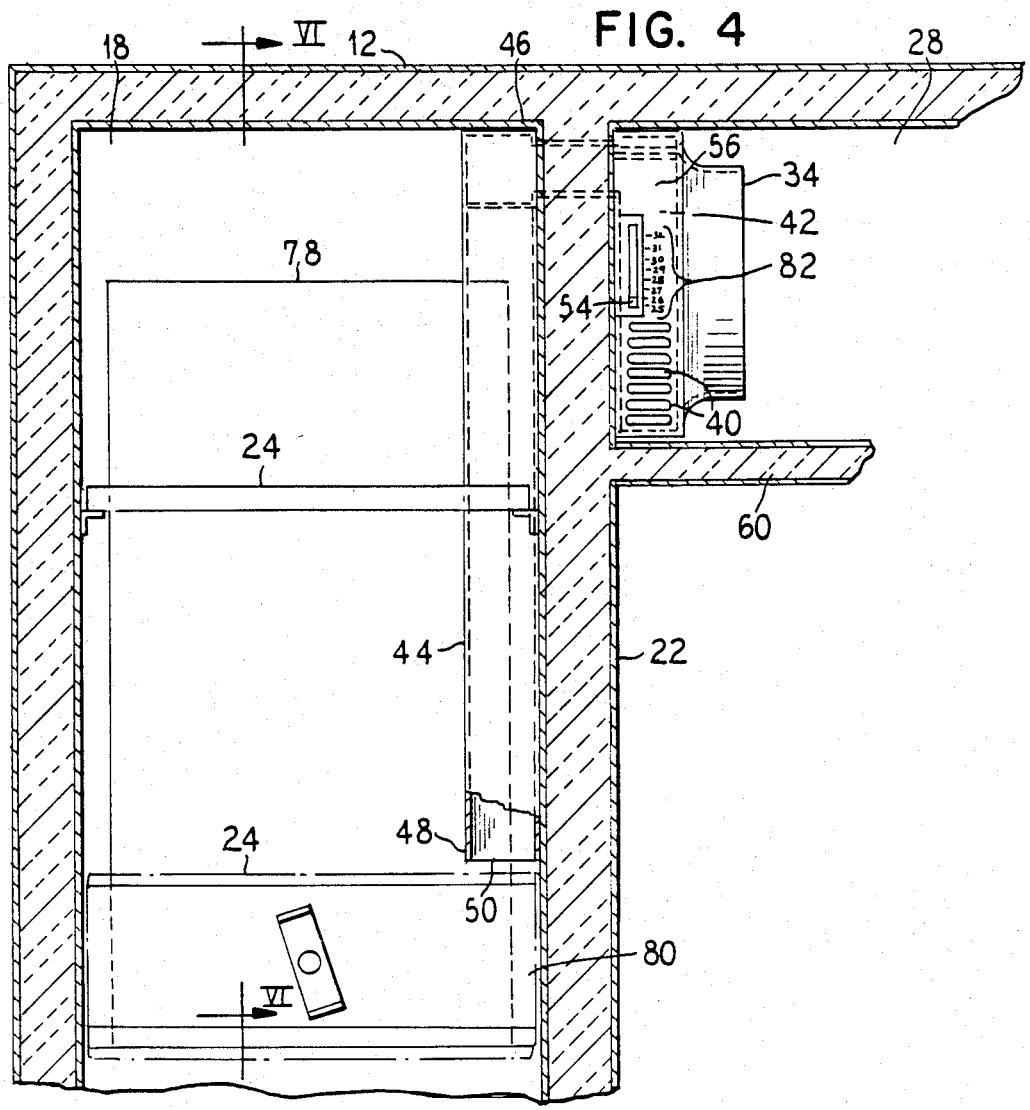
FIG. 4 is a cross-section taken along lines IV—IV of FIG. 3 showing the freezer air siphon and plenum chamber of the present invention.

FIG. 4 shows the freezer air siphon 44 extending into the freezer compartment 18 to draw freezer air from near a mid-portion thereof. Generally, cycling of the evaporator, or cooling mechanism, shown at 78, in the freezer compartment 18 causes temperature variations within the freezer 18. The temperature variations are particularly wide at the top of the freezer compartment 18 since cold air is forced to the top of the freezer compartment 18 when the cooling mechanism 78 is on and, when the cooling mechanism 78 is off, warmer air collects at the top of the freezer compartment 18. Air below the top of the freezer compartment 18 is less subject to temperature variations, and, in particular, air near the mid-portion of the freezer is relatively constant in temperature.

For purposes of the present invention, mid-portion, or horizontal mid-portion, refers to that portion of the freezer compartment spaced from the top and from the bottom of the freezer compartment in which a lower temperature variation occurs as the freezer cooling mechanism cycles.

In the embodiment shown, the air inlet 50 of the freezer air siphon 44 is disposed just above a shelf 24, below which is an ice maker 80. In this portion of the freezer compartment 18, the temperature variations are considerably reduced over that of the top of the freezer compartment 18 and, therefore, a more controlled temperature air is drawn into the plenum chamber 42 for mixing with the air within the controlled temperature compartment 28.

Also referring to FIG. 4, the slide control 54 includes a display 82 indicating the temperatures to which the air temperature within the controlled temperature compartment 28 may be set. The fan housing portion 34 can be seen projecting beyond the body of the plenum 32 to more effectively direct the air flow generated by the fan 36 throughout the compartment 28.

Figure 5:
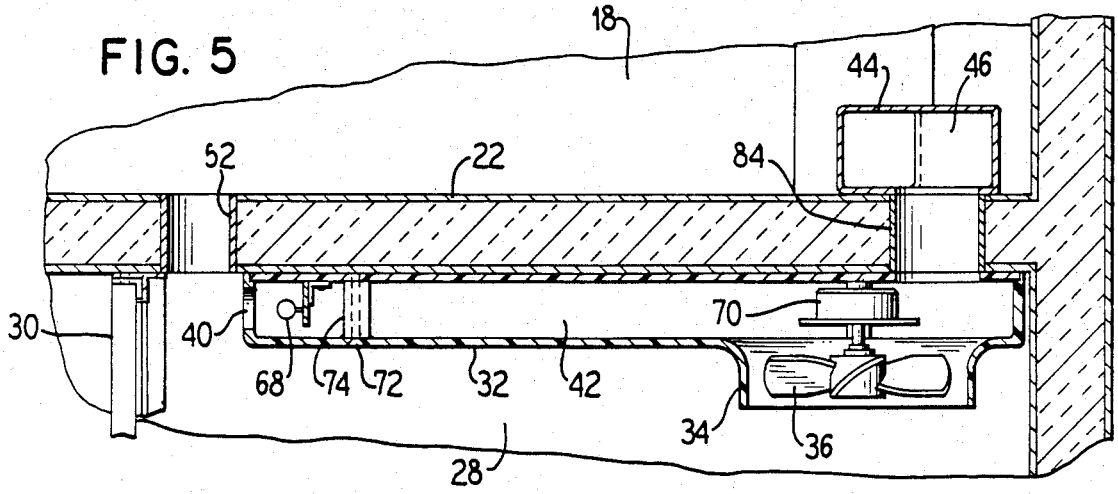
FIG. 5 is a horizontal cross-section taken along lines V—V of FIG. 3 showing additional details of the plenum chamber.
Figure 6:
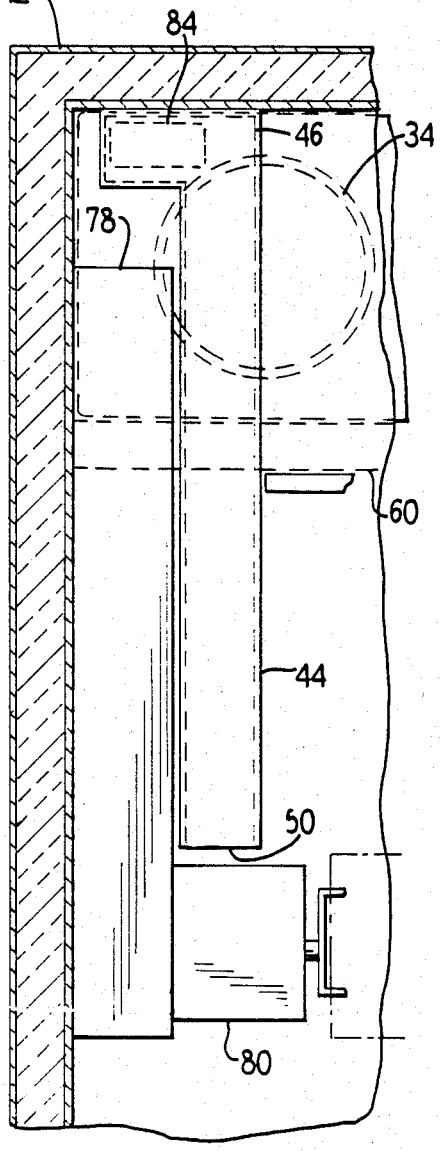
FIG. 6 is a partial elevational view taken along the lines VI—VI of FIG. 4 and showing the relationship of the freezer air siphon and the fan housing outlet.

Referring now to FIG. 5, the freezer air siphon 44 is disposed at the rear of the freezer compartment 18 while the air return 52 is at the front of the freezer compartment 18. A transverse cool air duct 84 at the top 46 of the siphon 44 extends through the wall 22 spaced somewhat laterally and, as can be seen in FIGS. 3 and 6, above the fan 36. Such arrangement provides for even distribution of the controlled temperature air, as well as for some mixing of the freezer air with the compartment air within the plenum chamber 42 and for controlled return of the compartment air to the freezer 18.

In FIG. 6, the relative sizes of the fan housing 34 and the transverse duct 84 of the freezer air siphon 44 are shown. The fan housing 34 is considerably larger than the transverse duct 84 so that a relatively large quantity of the temperature controlled compartment air is mixed with a relatively small quantity of colder freezer air. The siphon 44 is formed to accommodate the cooling mechanism 78 and to extend to just above the ice maker 80. The siphon 44 additionally prevents air from the cooling mechanism from being forced into the transverse duct 84 when the fan 36 is not operating.

Figure 7:
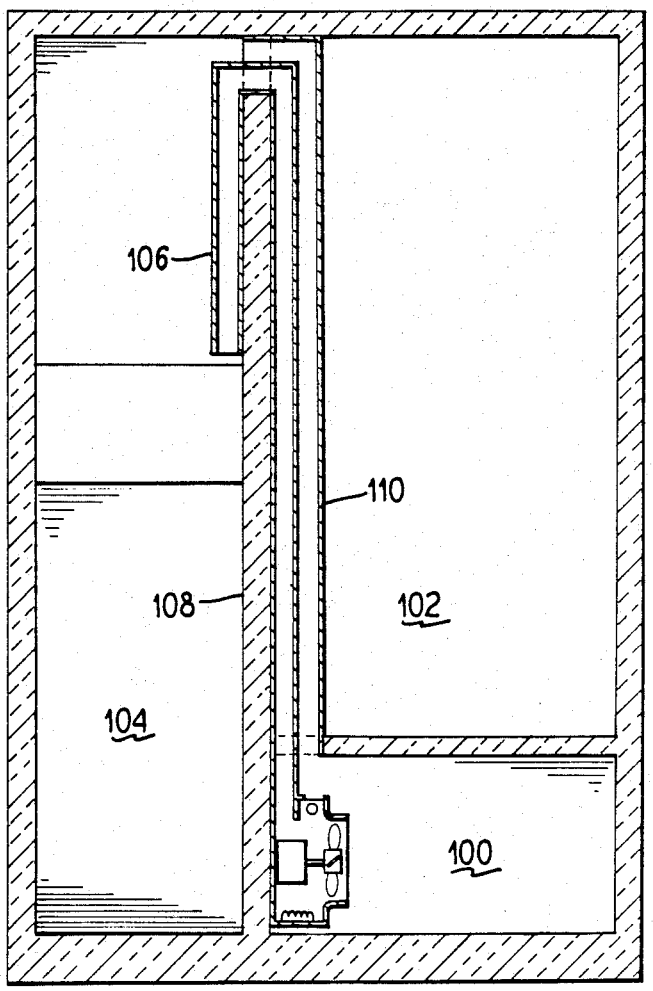
FIG. 7 is a vertical cross-section of another embodiment of the present invention having a controlled temperature compartment below the refrigerator compartment in a side-by-side refrigerator-freezer.

In FIG. 7 is shown a controlled temperature compartment 100 disposed beneath a refrigerator compartment 102, which draws cool air from a freezer compartment 104 through a freezer air siphon 106 extending upwardly from compartment 100 along the dividing wall 108 and then downwardly to near a mid-portion of the freezer compartment 104. An air return duct 110 is provided between the top of the controlled temperature compartment 100 and the top of the freezer compartment 104. The embodiment shown in FIG. 7 includes many of the features of the above-discussed embodiment, including drawing relatively constant temperature air from below the top of the freezer compartment 104. The freezer air siphon 106 and the return duct 110 both cross the adjoining wall 108 near the top thereof to prevent thermally induced air flow. The freezer air siphon 106 is shown adjacent the adjoining wall 108 while the return duct 110 extends alongside the siphon 106 and spaced from the wall 108 to prevent excessive warming of the freezer air as it passes downward to the controlled temperature chamber 100.

Figure 8:
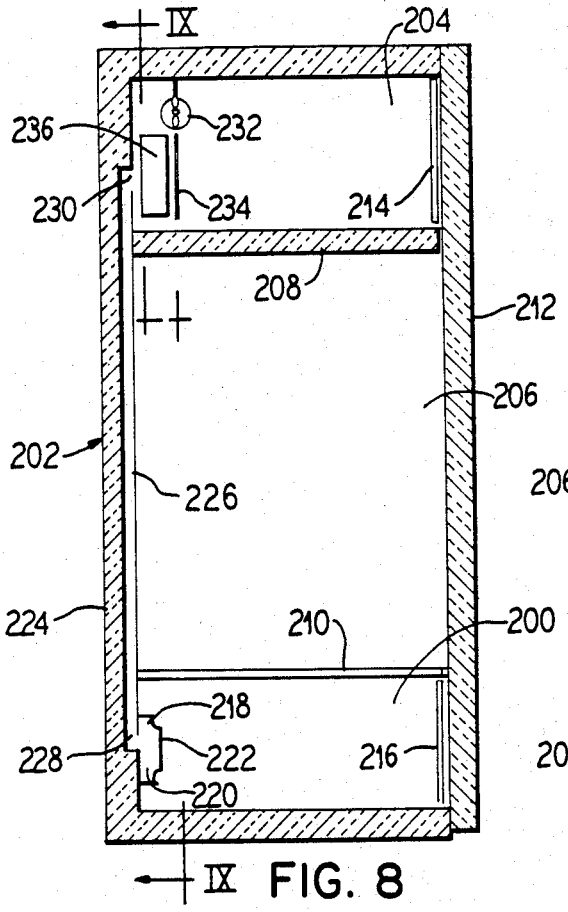
FIG. 8 is a vertical cross-section of a further embodiment of the present controlled temperature compartment in a top-freezer type refrigerator-freezer.

As shown in FIG. 8, a controlled temperature compartment 200 can also be provided in a refrigerator-freezer 202 which has a freezer compartment 204 above a refrigerator compartment 206. The refrigerator compartment 206 is separated from the freezer compartment 204 by a first dividing wall 208, while the controlled temperature compartment 200 is separated from the refrigerator compartment 206 by a second dividing wall 210. A main door 212 is hingedly mounted at the front of the refrigerator-freezer 202 for access to the refrigerator compartment 206. An interior freezer door 214 provides access to the freezer compartment 204, and an interior controlled temperature compartment door 216 provides access to the controlled temperature compartment 200.

Within the controlled temperature compartment 200 is a plenum housing 218 defining a plenum chamber 220, the plenum housing 218 being provided with a fan housing portion 222 projecting therefrom. The plenum housing 218 is mounted on an insulated rear wall 224 of the refrigerator-freezer 202. A freezer air siphon 226 is disposed in the insulated rear wall 224 and has a lower end 228 in communication with the plenum chamber 220. The freezer air siphon 226 extends upwardly along the insulated rear wall 224 and has an upper end 230 in communication with a horizontal mid-portion of the freezer compartment 204.

An evaporator fan 232 is mounted in a divider 234 which separates an evaporator 236 from a main portion of the freezer compartment 204. In the illustrated embodiment, the upper end 230 of the freezer air siphon 226 is in communication with a suction side of the evaporator fan 232. This prevent the evaporator fan 232 from forcing freezer air down the freezer air siphon 226 to the controlled temperature compartment 200, and thereby prevents inaccurate temperature sensing by a sensor (not shown) within the plenum chamber 220.

Figure 9:
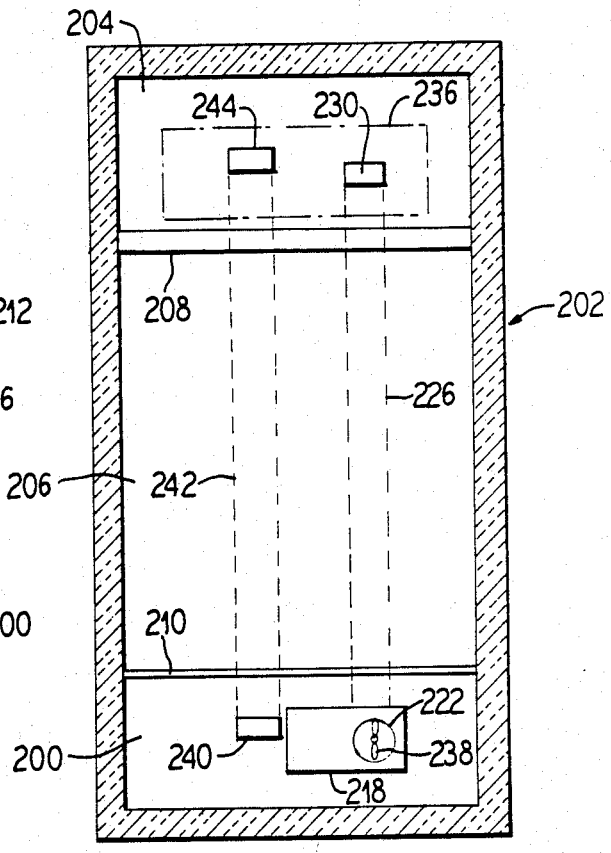
FIG. 9 is a cross-section along lines IX—IX of FIG. 8 showing the arrangement of the freezer air siphon and return duct.

Another view of the top-freezer type refrigerator-freezer unit 202 is shown in FIG. 9. The freezer air siphon 226 extends to behind a fan 238 mounted within the fan housing portion 222 of the plenum housing 218. In communication with the controlled temperature compartment 200 and outside of the plenum housing 218 is a lower end 240 of a return duct 242. The return duct 242, like the freezer air siphon 226, extends vertically along the insulated rear wall 224 and has an upper end 244 in communication with a horizontal mid-portion of the freezer compartment 204. Like the upper end 230 of the freezer air siphon 226, the upper end 244 of the return duct 242 is on the suction side of the evaporator fan 232. The upper end 244 of the return duct 242 is at a slightly higher elevation than the upper end 230 of the freezer air siphon 226. This prevents a reverse thermal cycling of the freezer air which could cause erroneous temperature sensing and control within the controlled temperature compartment 200. The upper ends 244 and 230 could also be at the same horizontal level to achieve this effect.

Figure 10:
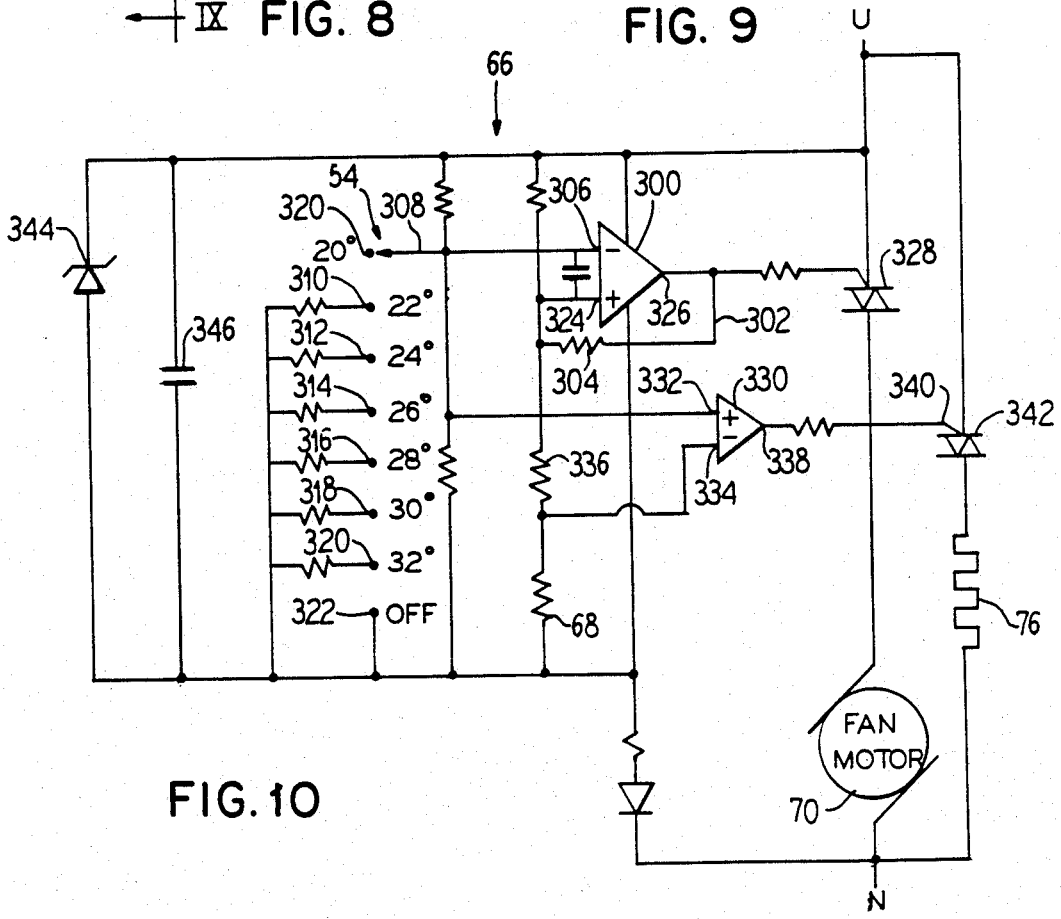
FIG. 10 is a diagram of an electrical control circuit as used in the present invention.

The control circuit 66 is shown in FIG. 10 including the slide control 54, the temperature sensor 68, the fan motor 70, and the heater element 76. An operational amplifier 300 is provided in the control circuit 66 which functions as a comparator and includes a positive feedback loop 302 including a resistor 304. The provision of positive feedback in the comparator 300 causes the comparator to exhibit hysteresis.

A reference voltage is set at an inverting input 306 of the comparator 300 by the slide control 54 which includes a movable contact 308 for connection with one of a plurality of pre-set resistance connections 310–318, as well as an open circuit connection 320 and a short circuit connection 322 to ground. The open circuit connection 320 corresponds to a 20° F. voltage reference level at the inverting input 306 of the comparator 300. Each of the connection points 310–318 have connected thereto resistors of respectively decreasing resistance so as to provide voltage reference levels in 2° F. increments. The short circuit connection 322 corresponds to an off-position of the slide control 54.

A non-inverting input 324 of the comparator 300 is fed with an input voltage as determined by the temperature sensor 68. Upon the input voltage at the non-inverting input 324 reaching the reference voltage level at the inverting input 306, the comparator 300 abruptly changes the voltage at an output 326 which is fed to a first thyristor 328, shown as a triac. The triac 328 controls the supply of power to the fan motor 70.

A second operational amplifier 330 also functions as a comparator, however, without the provision of feedback. A non-inverting input 332 of the comparator 330 is supplied with the reference voltage level as established by the slide control 54, while an inverting input 334 is supplied with an input voltage as determined by the temperature sensor 68. A voltage dividing resistor 336 maintains a voltage difference between the input 324 of a first comparator 300 and the input 334 of the second comparator 330, so that the second comparator 330 is triggered at a lower temperature. The resistor 336, thus, defines the dead band.

An output 338 of the comparator 330 is connected to a gate 340 of a second thyristor 342, also shown as a triac. When the triac 342 is triggered by the comparator 330, power is supplied to the heater element 76. The second comparator 330 and second triac 342 can obviously be eliminated from embodiments of the circuit 66 not requiring a heater 76.

A zener diode 344 and capacitor 346 are provided in the circuit 66 for power regulation.

The amplitude of the hysteresis provided by the first comparator 300, in a preferred embodiment, is approximately equal to 1° F. For instance, when the slide control 54 is set at the 20 degree connection 320, the comparator 300 triggers when the temperature sensor 68 senses a temperature of 20° F., thereby starting the fan motor 70. The fan motor 70 continues to run until the comparator 300 is reset at approximately 19° F., thereby preventing extremely rapid cycling of the fan motor 70.

The present invention, thus, provides a means and method for maintaining a compartment at a set temperature. Cold freezer air is drawn from a central region of a freezer and is tempered by mixing with air already circulating within the compartment.

In tests of the present device, the fan runs nearly continuously, either at varying speeds or on a rapid duty cycle. The resulting air circulation prevents air stratification within the compartment.

The set temperature is maintained throughout the compartment to within a fraction of a degree Fahrenheit. Such accurate temperature control enables foods to be stored for long periods, often without freezing injury. For example, ground beef was stored at 23° F. in a frozen condition for 51 days without detectable flavor loss. Fresh shellfish was stored in an unfrozen state at between 29° and 32° F. for three to seven days. And cherries were stored in a non-frozen storage zone of 32°-35° F. for 10 to 14 days without spoilage or chilling injury.

Although the present invention is disclosed and described in a combination refrigerator-freezer, it is within the bounds of the present invention to provide a controlled temperature compartment in conjunction with a freezer unit.

Although modifications and changes may be suggested by those skilled in the art, it is the intention of the inventor to embody within the patent warranted hereon all changes and modifications as reasonably and properly come within the scope of his contribution to the art.

The embodiments of the invention in which an exclusive property or privilege is claimed are defined as follows:

1. In a combined refrigerator-freezer of the type including a compartmented cabinet including a freezer compartment and a refrigerator compartment, a controlled temperature compartment for extended storage of perishable items and formed as a separate compartment in said cabinet, comprising:

means for defining a plenum chamber within said separate compartment including first and second air openings providing communication between said separate compartment and said plenum chamber, said first air opening being spaced from said second air opening;

first and second air conduits extending between and in communication with said separate compartment and the freezer compartment, said first air conduit having first and second opposite ends, said first end of said first air conduit extending to a horizontal mid-portion of said freezer compartment and defining a third air inlet opening at said freezer compartment mid-portion, said second opposite end of said first air conduit being in communication with said plenum chamber;

means for driving an air flow through said first air opening from said plenum chamber, said air flow driving means drawing air into said plenum chamber through said second air opening and through said first air conduit; and means for controlling said air flow driving means depending on the air temperature within said separate compartment.

2. The combined refrigerator-freezer in claim 1, wherein said air flow driving means includes a fan and fan motor.

3. The combined refrigerator-freezer in claim 1, wherein said controlling means includes a temperature sensor mounted at said second air opening of said plenum chamber defining means.

4. The combined refrigerator-freezer in claim 1, wherein said second opposite end of said first air conduit is disposed at substantially the same horizontal level as an inlet end of said second air conduit at said separate compartment.

5. In a combination refrigerator-freezer unit having a freezer compartment and a refrigerator compartment, a controlled temperature compartment for extended storage of perishable items, comprising:

an enclosure contained within the refrigerator-freezer unit defining a controlled temperature compartment;

an openable door mounted for closure over said enclosure;

a plenum mounted within said enclosure and defining a plenum chamber within said controlled temperature compartment in which air is mixed;

a fan mounted for directing a flow of air from said plenum chamber into said controlled temperature compartment, said plenum having a fan outlet through which the fan air flow is directed;

means for controllably driving said fan;

means for controlling said fan driving means dependent upon predetermined temperatures of the air within said enclosure;

a first air inlet in said plenum spaced from said fan outlet and providing communication between said controlled temperature compartment and said plenum chamber;

an air siphon having an outlet in communication with said plenum chamber and an inlet in communication with a horizontal mid-portion of an interior of the freezer compartment; and an air return communicating between the freezer compartment and said enclosure;

whereby operation of said fan draws controlled temperature compartment air through said first air inlet and draws freezer compartment air through said air siphon and expels a combination of the two airs from said fan outlet into said controlled temperature compartment.

6. A combination refrigerator-freezer unit as defined in claim 5, further comprising:

a shaped fan housing at said fan outlet for directing the air flow.

7. A unit as defined in claim 5, further comprising:

settable means for varying the predetermined temperatures at which said controlling means controls said fan driving means.

8. A unit as defined in claim 7, further comprising:

a heater mounted within said plenum chamber and controlled by said temperature dependent controlling means.

9. A controlled temperature compartment as claimed in claim 8, wherein said temperature dependent controlling means includes:

a control circuit having first and second comparators, said first comparator having an output connected to control the operation of said fan driving means and having first and second inputs, said first input of said first comparator connected to said settable means for receiving a selectively predetermined signal said second comparator having an output connected to control the operation of said heater and having first and second inputs, said first input of said second comparator connected to said settable means to receive said selectively predetermined signal; and a temperature sensor mounted at said first air inlet of said plenum for sensing the temperature of said controlled temperature compartment and producing a corresponding temperature signal, said temperature sensor being connected to supply said temperature signal to said second input of said first comparator and to said second input of said second comparator.

10. A controlled temperature compartment as claimed in claim 9, wherein said first input of said first comparator is an inverting input, and wherein said first input of said second comparator is a non-inverting input.

11. In a side-by-side refrigerator-freezer unit having a common wall separating a freezer compartment from a refrigerator compartment, compartmenting means in said unit forming a separate compartment independent of said freezer compartment and said refrigerator compartment;

an openable door mounted to close said separate compartment;

a plenum defining an air mixing chamber and mounted adjacent said common wall within said separate compartment, an air inlet and an air outlet being formed in said plenum, said air inlet being spaced from said air outlet;

a siphon tube mounted within the freezer compartment and having a first end including a cold air inlet at a horizontal mid-portion of said freezer compartment, a second opposite end of said siphon tube having a cross-over extending through said common wall and communicating with said air mixing chamber in an interior of said plenum;

an air return conduit in communication between said separate compartment and the freezer compartment and having a cross-over through said common wall, said air return conduit having an opening communicating with a top of said separate compartment;

a temperature sensor mounted to detect air temperature within said separate compartment;

a fan and a controllable fan motor mounted to direct an air flow from said plenum air outlet into said separate compartment, said fan and fan motor operable to draw air into said mixing chamber through said air inlet in said plenum and through said siphon tube from the freezer compartment, a portion of the air within said separate compartment flowing through said air return conduit to the freezer compartment as said fan and fan motor operates; and a control circuit connected to control said fan and said fan motor depending on the temperature sensed by said temperature sensor;

whereby said fan directed air flow circulates throughout said separate compartment to maintain a low temperature differential.

12. In a unit as defined in claim 11, said separate compartment being disposed above the refrigerator compartment and said siphon tube comprising a dip tube extending from the upper part of the unit to said horizontal mid-portion of the freezer compartment.

13. In a unit as defined in claim 11, said separate compartment being disposed below said refrigerator compartment.

14. In a unit as defined in claim 13, a communicating conduit extending from said dip tube cross-over to said air mixing chamber within said plenum, said communicating conduit being on the refrigerator side of the common wall; and said air return conduit at substantially the same horizontal level as said communicating conduit.

15. A top-freezer type refrigerator-freezer unit having a common wall separating a freezer compartment from a refrigerator compartment, comprising:

compartmenting means in said refrigerator-freezer unit forming a separate compartment independent of said freezer compartment and said refrigerator compartment;

an openable door mounted to close said separate compartment;

a plenum housing defining a plenum chamber and mounted adjacent a wall within said separate compartment, said plenum housing having an air inlet and an air outlet spaced from each other;

a siphon tube having a first end including a freezer air inlet at a horizontal mid-portion of said freezer compartment, a second opposite end of said siphon tube in communication with said plenum chamber within said plenum housing;

a return duct having an inlet end open to said separate compartment outside said plenum housing and an outlet end in communication with a horizontal mid-portion of said freezer compartment to provide an air flow between said separate compartment and said freezer compartment;

a temperature sensor mounted to detect air temperature within said separate compartment;

a fan and controllable fan motor mounted to direct an air flow from said plenum air outlet into said separate compartment, said fan and fan motor operable to draw air into said plenum chamber through said plenum air inlet from said separate compartment and through said siphon tube from said freezer compartment, a portion of the air within said separate compartment flowing through said return duct to said freezer compartment as said fan and said fan motor operation;

a control circuit connected to control said fan and said fan motor corresponding to changes in temperature sensed by said temperature sensor;

whereby said fan circulates an air flow throughout said separate compartment to maintain a relatively constant temperature for long term food storage.

16. A top-freezer type refrigerator-freezer unit as claimed in claim 15, wherein said siphon tube and said return duct extend parallel to one another vertically along an insulated wall of said refrigerator-freezer unit; and wherein said freezer compartment has an evaporator fan, said freezer air inlet of said siphon tube and said outlet end of said return duct being in communication with a suction side of said evaporator fan.

17. A top-freezer type refrigerator-freezer unit as claimed in claim 15, wherein said control circuit includes a comparator connected to receive a predetermined reference signal for comparison to a signal from said temperature sensor, an output of said comparator connected to control the operation of said fan and said fan motor.

18. A top-freezer type refrigerator-freezer as claimed in claim 17, further comprising:

means for selectively setting said predetermined reference signal for receipt by said comparator to change the temperature at which said fan and said fan motor operate.

19. A method for cooling a separate compartment in a combination refrigerator-freezer unit to a predetermined temperature, comprising the steps of:

drawing a supply of cold air from a horizontal mid-portion of the freezer, said horizontal mid-portion being a horizontal region spaced from a top and botton of the freezer, tempering the supply of cold freezer air with air drawn from the separate compartment;

directing the thus tempered air in the form of an air stream into the separate compartment; and directing a flow of return air from the separate compartment to a different portion of the freezer.

20. A method as defined in claim 19, further comprising the steps of:

sensing air temperature of the tempered air, and regulating the flow of air as a function of such air temperature.

21. A method as defined in claim 20, further comprising the step of:

heating the tempered air drawn from the separate compartment upon sensing air temperatures below the predetermined temperature minus a dead band.

22. A method for cooling a separate compartment in a combination refrigerator-freezer unit to a predetermined temperature, comprising the steps of:

drawing a supply of cold air from a horizontal mid-portion of the freezer;

tempering the supply of cold freezer air with air drawn from the separate compartment;

directing the thus tempered air in the form of an air stream into the separate compartment;

directing a flow of return air from the separate compartment to a different portion of the freezer;

sensing the air temperature of the tempered air;

regulating the flow of air as a function of air temperature;

selecting a first signal level corresponding to a predetermined temperature;

generating a second signal level corresponding to said sensed air temperature;

comparing said first signal level to said second signal level; and controlling the step of directing the tempered air depending on whether said first signal is greater than said second signal.

* * * * *